US006700836B1

(12) United States Patent
Satodate et al.

(10) Patent No.: US 6,700,836 B1
(45) Date of Patent: Mar. 2, 2004

(54) ELECTRONIC TIMEPIECE WITH INDICATOR HANDS

(75) Inventors: Takayuki Satodate, Chiba (JP); Yuichi Shino, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 09/937,093

(22) PCT Filed: Apr. 6, 2000

(86) PCT No.: PCT/JP00/02248

§ 371 (c)(1),
(2), (4) Date: Jan. 3, 2002

(87) PCT Pub. No.: WO01/55802

PCT Pub. Date: Aug. 2, 2001

(30) Foreign Application Priority Data

Jan. 24, 2000 (WO) ..... PCT/JP00/00324

(51) Int. Cl.[7] ..... G04B 19/00; G04B 19/94; G04B 19/06; G04B 25/00

(52) U.S. Cl. ..... 368/76; 368/80; 368/223

(58) Field of Search ..... 368/72–74, 76, 368/80, 223, 228, 238

(56) References Cited

U.S. PATENT DOCUMENTS 4,421,421 A * 12/1983 Bradt ..... 368/229
5,202,858 A * 4/1993 Kanzaki ..... 368/71
5,889,736 A * 3/1999 Fujita et al. ..... 368/66

FOREIGN PATENT DOCUMENTS

JP 60-68491 * 5/1985
JP 5-38592 * 5/1993

* cited by examiner

*Primary Examiner*—Vit Miska
(74) *Attorney, Agent, or Firm*—Adams & Wilks

(57) ABSTRACT

An electronic timepiece (100) is provided that has indicator hands capable of providing various indications. The electronic timepiece with indicator hands, characterized by comprising a time hand (101, 102) indicative of time, first and second indicator hands (103, 104) separately provided from the time hand (101, 102), and drive means for reciprocally rotating the first and second indicator hands (103, 104) in opposite directions to each other within a predetermined range.

15 Claims, 10 Drawing Sheets

(a)

(b)

ELECTRONIC TIMEPIECE WITH INDICATOR HANDS

CROSS REFERENCE TO RELATED APPLICATIONS

This application is a U.S. national stage application of copending International Application Ser. No. PCT/JP00/02248, filed Apr. 6, 2000, claiming a priority date of Jan. 24, 2000, and published in a non-English language.

TECHNICAL FIELDS

The present invention relates to an electronic timepiece with indicator hands integrally formed with figures or the like.

BACKGROUND OF THE INVENTION

Conventionally, there have been utilized electronic timepieces with indicator hands integrally formed with figures such as characters.

In conventional electronic timepieces with indicator hands, a hand having the function of an indicator hand is structured by a needle-like second hand or a disk-shaped second hand, wherein the second hand serves also as the indicator hand. Also, in a conventional electronic timepiece having an indicator hand to be operated only by manual operation of the user, the indicator hand serves also as a time hand indicative of time or interacts with a time indicating hand.

Consequently, in any of the above electronic timepieces, there was nothing more than one indicator hand serving also for time indication. With one indicator hand, it was impossible to provide a figure such as a character or other fanciful image with a variety of movements and a variety of indications.

Meanwhile, although there has existed electronic timepieces having an indicator hand moving at all times, they have done nothing more than providing a figure or the like on a disk-shaped second hand or needle-like second hand and could not have made a variety of indications, such as providing a variety of movements.

Meanwhile, where the indicator hand serves also as a time hand or interacts with the time hand, the figure or the like to be integrally formed on the indicator hand is restricted in size making it difficult to use an indicator hand capable of a variety of indications.

It is an object of the present invention to provide an electronic timepiece with indicator hands capable of a variety of indications.

DISCLOSURE OF THE INVENTION

The present invention adopts a technical structure as described below in order to achieve the above object.

That is, the present invention is an electronic timepiece with indicator hands, characterized by comprising: a time hand indicative of time, first and second indicator hands separately provided from the time hand, and drive means for reciprocally rotating the first and second hands in opposite directions to each other within a predetermined range. The drive means reciprocally rotates the first and second indicator hands in directions opposite to each other within a predetermined range. This enables a variety of indications by the indicator hands integrally formed with a figure such as a character.

Here, the drive means may reciprocally rotate the first and second hands at a same speed.

Also, the drive means may have a motor rotating forward and reverse alternately and train wheel for conveying rotation of the motor to the first and second indicator hands.

Furthermore, the train wheel may have a first train wheel to convey rotation in a direction reverse to said motor to the first indicator hand and a second train wheel to convey rotation in a direction same as the motor to the second indicator hand.

Still furthermore, the time hand and the indicator hands may be arranged on a same shaft.

Also, the drive means may have a gear and a pinion which constitute 2 stages up and down, may contain a diameter of the pinion is smaller than the gear and the number of tooth of the pinion are the same as that of the gear.

Also, the drive means may have the first hour wheel to rotatively drive the indicator hand, a wheel for reverse rotation and the second hour wheel to rotatively drive the indicator hand. The wheels may transfer a rotation of the motor to the hour wheels by the gears and transfer to the hour wheels through the wheel for reverse rotation by the pinions.

Also, the drive means may have an operation switch, sound output means, rotation means to reciprocally rotate the first and second indicator hands in directions opposite to each other, control means, and storage means storing first drive signal data to control the rotation means such that the first and second indicator hands perform first reciprocal rotational movement in directions opposite to each other, sound data and second drive signal data to control the rotation means such that the first and second indicator hands perform second reciprocal rotational movement in directions opposite to each other, wherein the control means controls the rotation means to cause the first and second indicator hands to perform first reciprocal rotational movement in directions opposite to each other due to the first drive signal data when the operation switch has not been operated, and outputs the music data to the sound output means and controls the rotation means to cause the first and second indicator hands to perform second reciprocal rotational movement in directions opposite to each other due to the second drive signal data when operation of the operation switch has been operated.

The rotation means under control of the control means drives, by the first drive signal data, the first and second indicator hand to perform first reciprocal movement in directions opposite to each other when the operation switch has not been operated. Also, when operation of the operation switch is operated, music data is outputted to the sound output means, and by the second drive signal data the first and second indicator hands are driven to perform second reciprocal rotational movement different from the first reciprocal rotational movement in directions opposite to each other, e.g., random reciprocal rotational movement.

Incidentally, the electronic timepiece may be an electronic wristwatch.

BEST MODE FOR CARRYING OUT THE INVENTION

Hereunder, concrete examples of electronic timepieces with indicator hands according to the present invention will be explained in detail with reference to the drawings.

Figure 1:
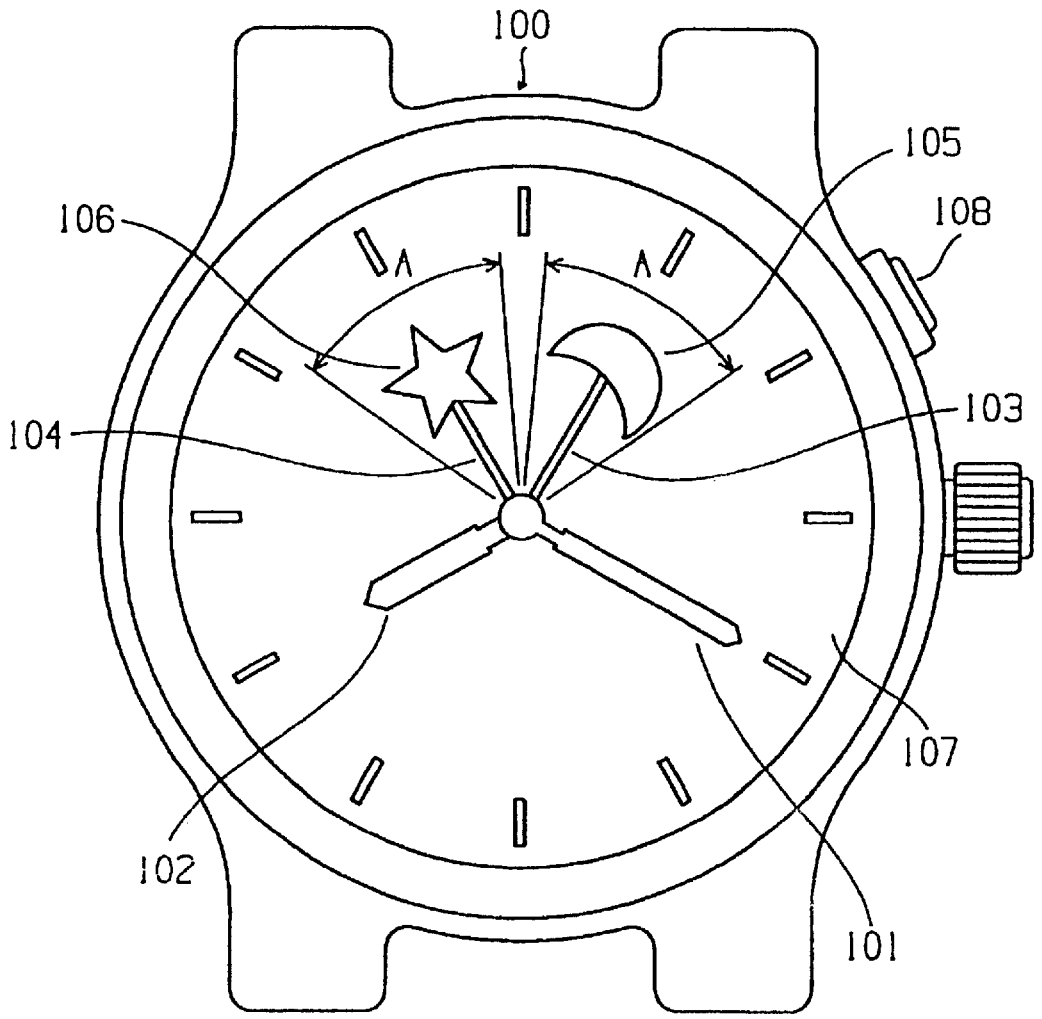
FIG. 1 is a front view showing an external appearance of one concrete, example of an electronic timepiece with indicator hands according to the present invention.

FIG. 1 is a front view of showing an external appearance of a concrete example of an electronic timepiece with indicator hands according to the invention, and, in particular, showing an example of an electronic wristwatch embodying the present invention. In FIG. 1, an electronic wristwatch 100 has time hands comprising a minute hand 101 and hour hand 102 to indicate time, and is provided with a first indicator hand 103 integrally formed with a crescent-shaped FIG. 105, a second indicator hand 104 integrally formed with a star-shaped FIG. 106 and an operation switch 108. The indicator hands 103, 104 are arranged between the minute hand 101 and hour hand 102 and the dial 107 having time indicating indicia provided thereon.

As described later, two systems of train wheels are used having one motor as a drive source different from a motor for driving the time hands 101, 102 and conveying oppositely reverse rotation to the indicator hands 103, 104 at a reduction ratios corresponding to a second hand, thereby rotatively driving the indicator hands 103, 104 in pair in a manner reciprocally moving them in opposite directions to each other at a same rate and within a predetermined range of angle A.

Figure 2:
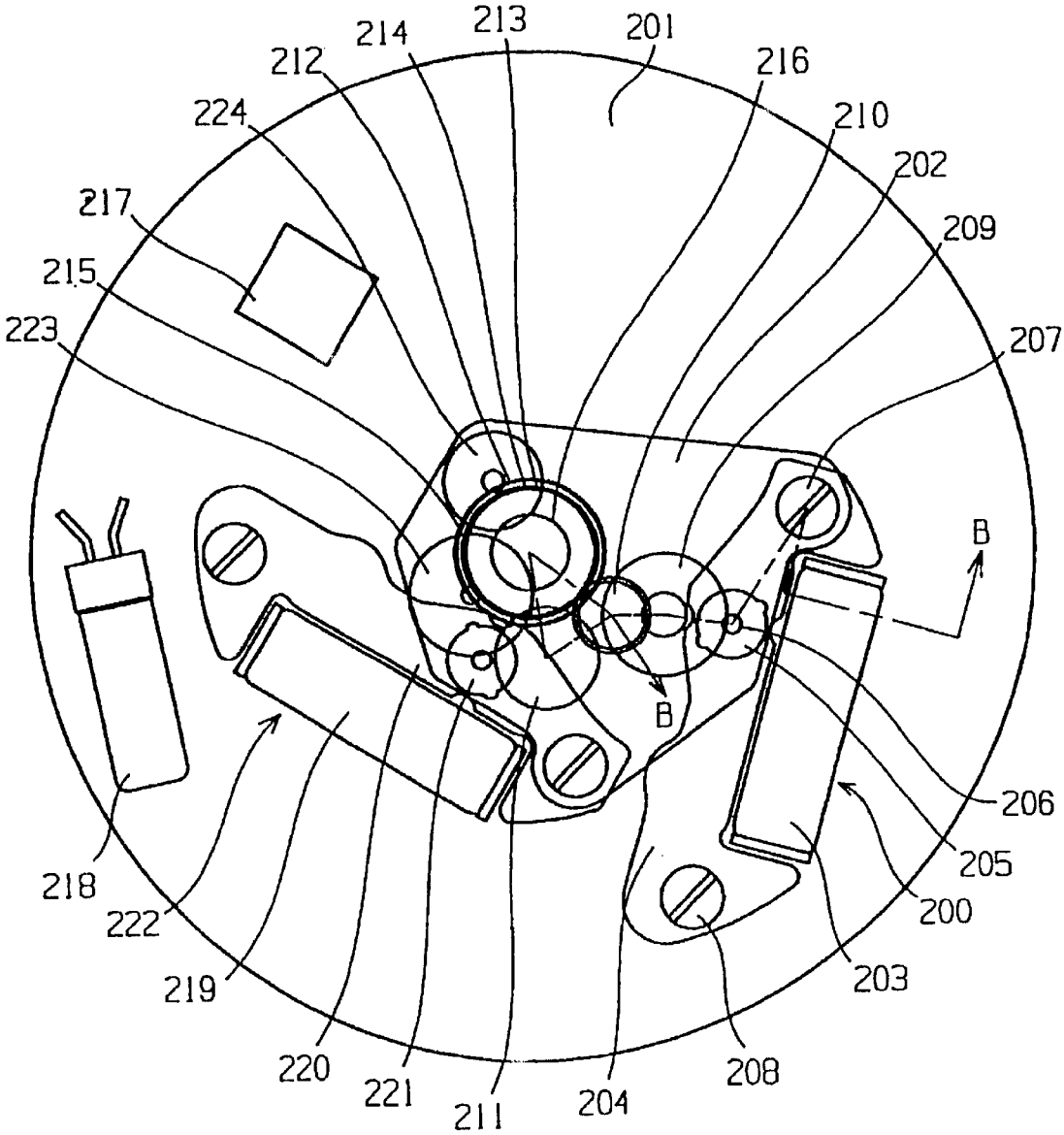
FIG. 2 is a rear view of a drive mechanism used in the one concrete example of the electronic timepiece with indicator hands according to the invention.
Figure 3:
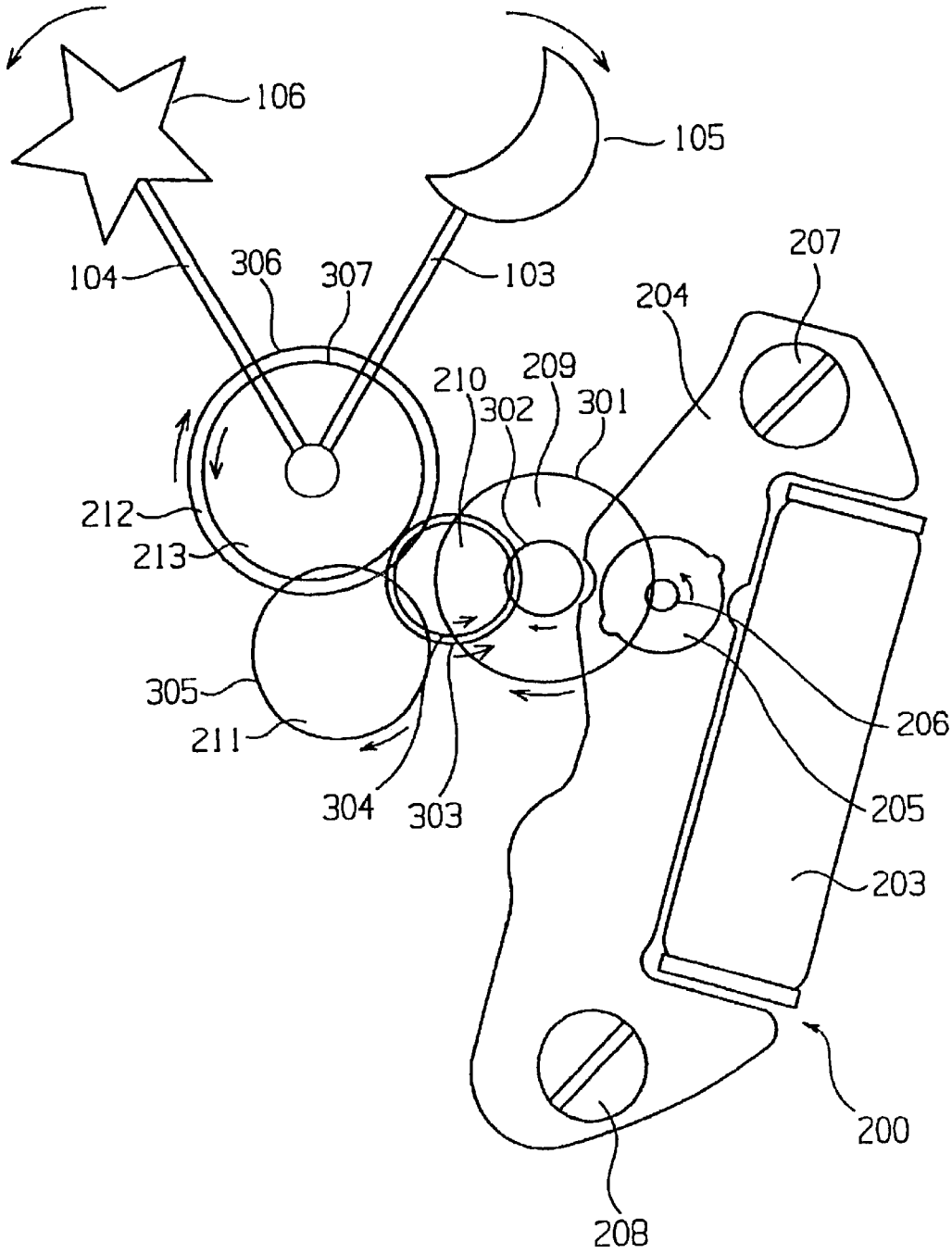
FIG. 3 is a magnified rear view of the drive mechanism used in the one concrete example of the electronic timepiece with indicator hands according to the invention.
Figure 4:
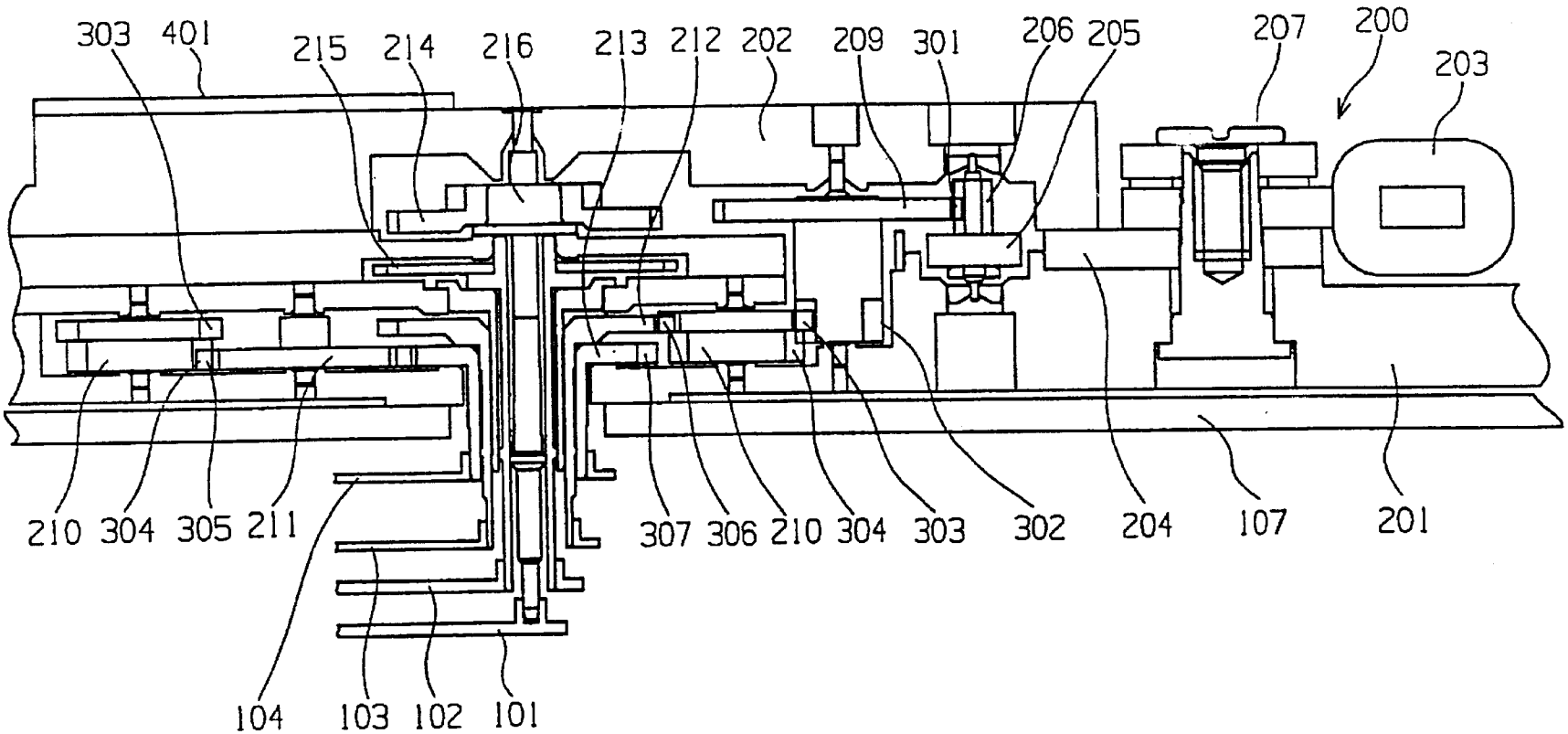
FIG. 4 is a B—B sectional view in FIG. 2.
Figure 5:
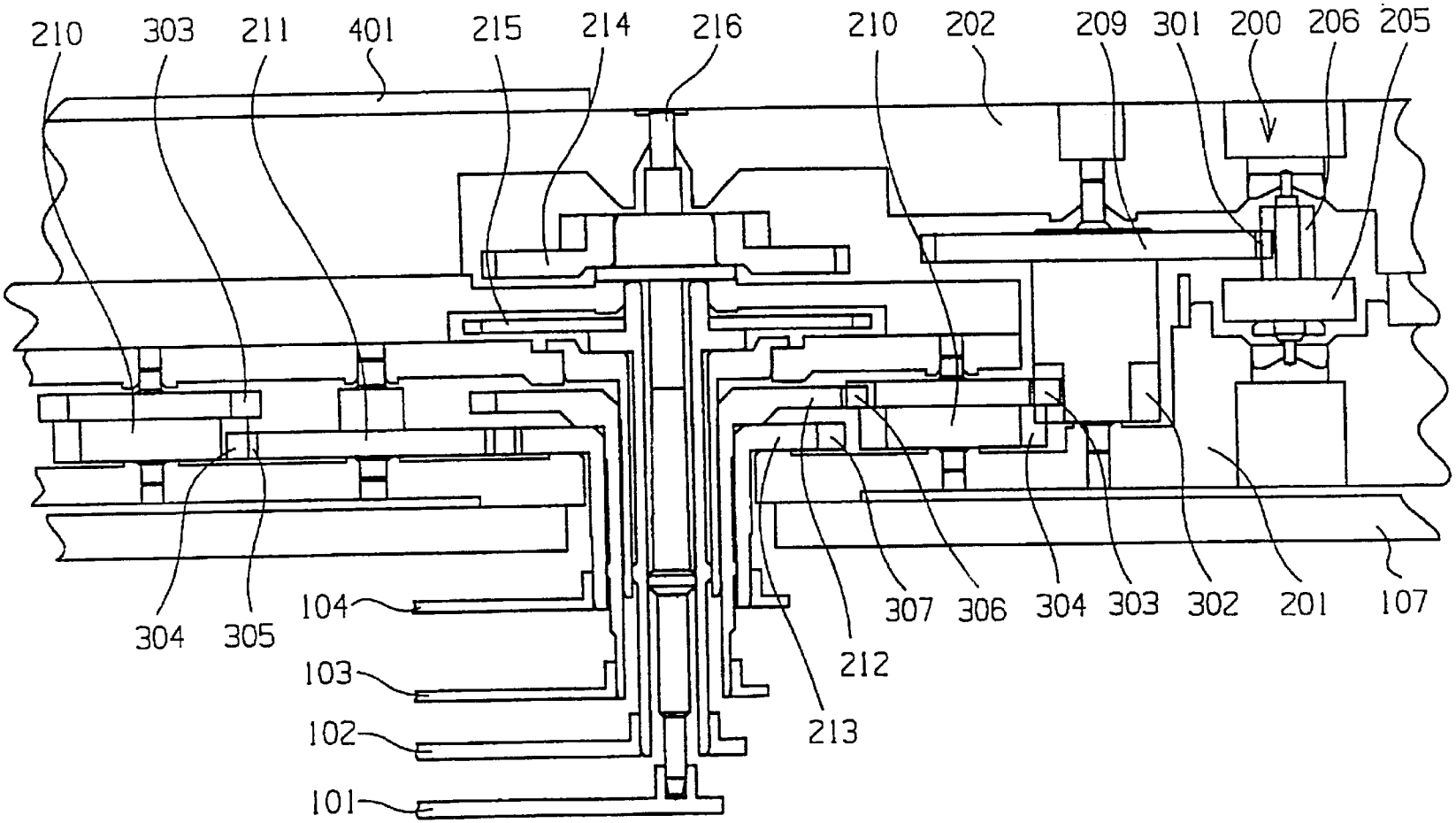
FIG. 5 is a fragmentary magnified sectional view of FIG. 4.
Figure 6:
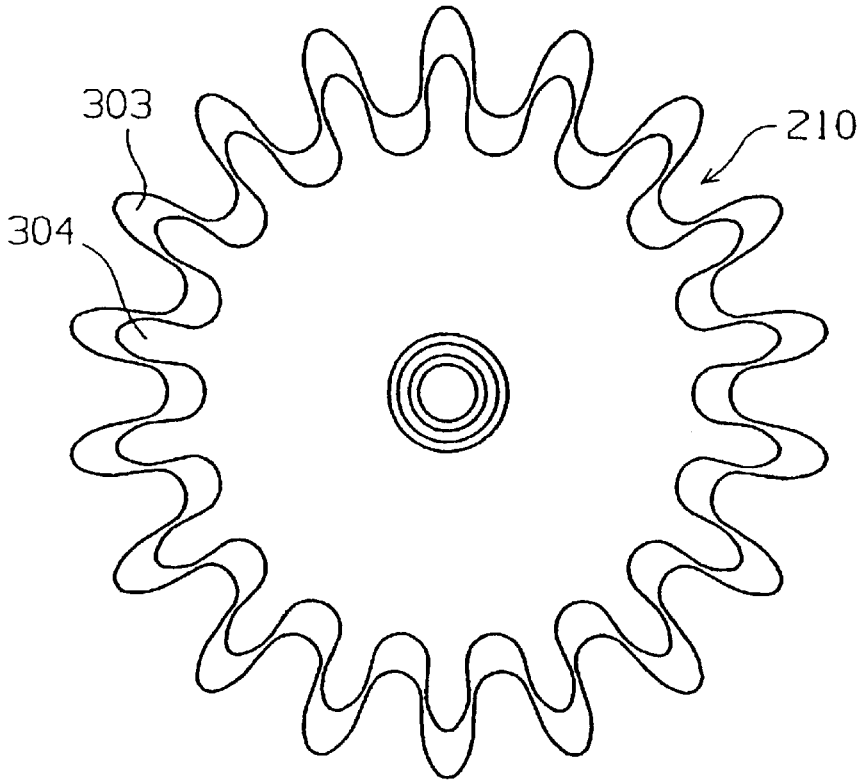
FIGS. 6A and 6B are a front and a side views of a wheel which uses one concrete example of an electronic timepiece with indicator hands according to the present invention.
Figure 6:
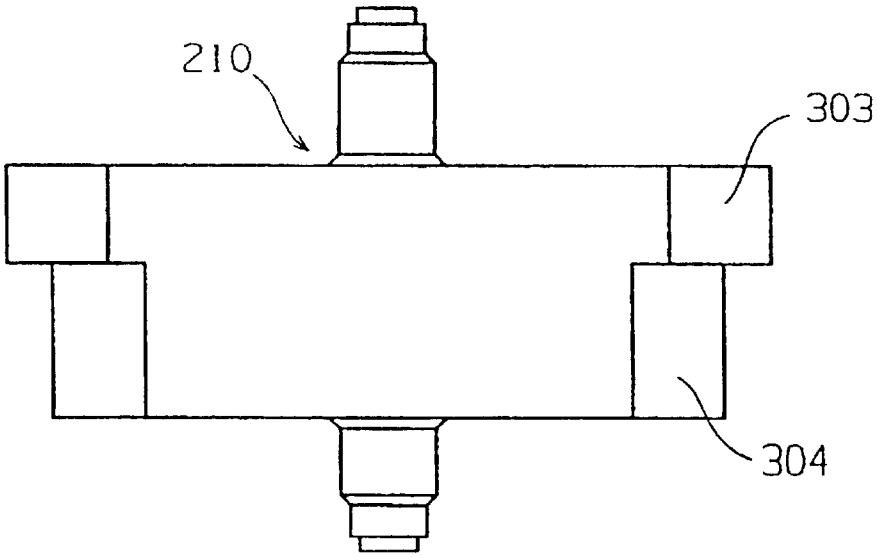

FIG. 2 is a backside view showing a drive mechanism of the electronic wristwatch 100 with indicator hands shown in FIG. 1, FIG. 3 is a magnified backside view showing the drive mechanism of the electronic wristwatch 100 with indicator hands shown in FIG. 1, FIG. 4 is a B—B sectional view in FIG. 2, FIG. 5 is a fragmentary magnified sectional view of FIG. 4, and FIGS. 6 are a front and a side views of a wheel which uses the present embodiment, wherein the same parts are denoted by the same reference numerals.

In FIG. 2 to FIG. 6, between a main plate 201 and a support plate 202 are accommodated means for rotating time hands comprising the minute hand 101 and the hour hand 102, a drive mechanism for rotatively driving the pair of indicator hands 103, 104 and an electronic circuit. Specifically, the structure is provided as follows.

A first stepping motor 200, structured by a coil 203, a stator 204 and a rotor magnet 205, is a well-known stepping motor (e.g., see Japanese Patent Laid-open No. 127365/1979), which performs forward rotation and reverse rotation to reciprocally rotate the indicator hands 103, 104 in opposite directions to each other within a predetermined range (within an angular range A of FIG. 1). The stator 204 and the coil 203 are fixed on the main plate 201 through screws 207, 208.

A gear 206 of the rotor magnet 205 is in mesh with a gear 301 of a wheel 209. A pinion 302 of the wheel 209 is in mesh with a gear 303 of a wheel 210. Also, the gear 303 of the wheel 210 is in mesh with a gear 306 of an hour wheel 212 to rotatively drive the indicator hand 103.

Meanwhile, a pinion 304 of the wheel 210 is in mesh with a gear 305 of a wheel 211 for reverse rotation. Also, the gear 305 of the wheel 211 is in mesh with a gear 307 of the hour wheel 213 for rotatively driving the indicator hand 104.

The wheel 210 is constituted by 2 stages in up and down directions by the gear 303 and the pinion 304, as shown in the front view and the side view in FIGS. 6(*a*) and 6(*b*). The pinion 304 has a smaller diameter than the gear 303. The number of teeth of the pinion 304 and the gear 303 are the same. The wheel 210 thus constitutes 2-stage structure by the gear 303 and the pinion 304 whose diameters are different, whose number of teeth are the same and whose module of teeth are different. Therefore the pinion 304 has a diameter without meshing interference of the wheel 209 and the hour wheel 213 is able to enlarge the diameter as possible. Here, the wheels 209, 210 and the hour wheel 212 constitute a first wheel train to convey, to the first indicator hand 103, reverse rotation with respect to the rotational direction of the motor 200 (i.e., rotation direction of the rotor magnet 205). The wheels 209, 210, 211 and the hour wheel 213 constitute a second wheel train to convey, to the second indicator hand 104, rotation in the same direction as the rotational direction of the motor 200.

The gear ratio of the first wheel from the pinion 302 of the wheel 209 to the gear 306 of the hour wheel 212 is the same as the gear ratio of the second train wheel from the pinion 302 of the wheel 209 to the gear 307 of the hour wheel 213. The indicator hand 103 and the indicator hand 104 are thus rotatively driven at the same speed but opposite in direction to each other. This rotatively drives the crescent-shaped figure 105 integrally formed on the indicator hand 103 and the star-shaped figure 106 integrally formed on the indicator hand 104 at the same speed but opposite in direction to each other.

Also, on the support plate 202 is arranged a piezoelectric element 401 in a disk form as sound output means.

Incidentally, the stepping motor 200, the wheels 209, 210, 211, the hour wheel 212 and hour wheel 213 constitute rotation means to rotate the first and second indicator hands 103, 104 oppositely within the predetermined range.

On the other hand, the wristwatch 100 is provided with a structure to rotatively drive the minute hand 101 and the hour hand 102. That is, provided are a second stepping motor 222 structured by a coil 219, a stator 220 and a rotor magnet 221 as well as a third train wheel structured by a wheel 214 to rotatively drive the wheels 223, 224 for conveying rotation of the rotor magnet 221 and the minute wheel 101, and an hour wheel 215 to rotatively drive the hour hand 102.

The hour wheels 212, 213, 215 are concentrically arranged on a shaft 216 integrally formed with the wheel 214. Due to this, the minute hand 101, the hour hand 102 and the indicator hands 103, 104 are arranged on the same shaft. Consequently, because of the lack of need for an exclusive space for mounting the indicator hand 103, 104, size reduction is feasible and a united feeling with the design on the dial 107 is possible to provide.

Meanwhile, an electronic circuit is incorporated which comprises an integrated circuit 217 incorporating a quartz oscillator 218 constituting an oscillator circuit and a drive circuit.

Figure 7:
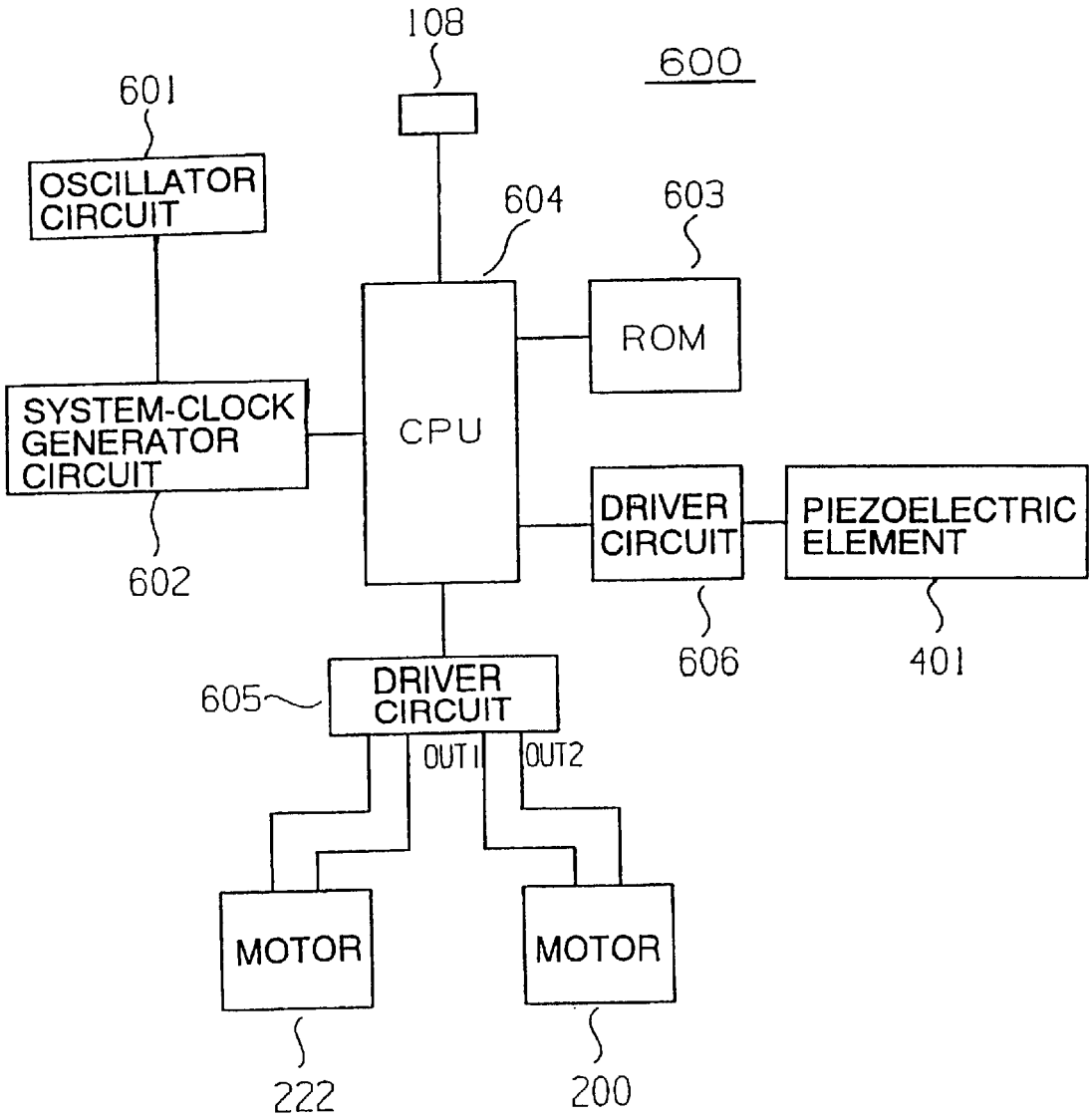
FIG. 7 is a block diagram of a drive circuit in the one concrete example of the electronic timepiece with indicator hands according to the invention.

FIG. 7 is a block diagram of a drive circuit 600 used in one concrete example of the electronic timepiece with indicator hands according to the invention, wherein the same parts as FIG. 1 to FIG. 6 are denoted by the same reference numerals. In FIG. 7, the drive circuit 600 has an oscillator circuit 601 configured by quartz oscillator 218, etc., a system-clock generator circuit 602 to generate a system clock from an output signal of the oscillator circuit 601, a non-volatile read only memory (ROM) 603 as storage means, a central processor unit (CPU) 604 as control means to operate on a program stored in the ROM 603 in response to a system clock from the system-clock generator circuit 602 and perform various operation processes, drive control, etc., a driver circuit 605 to supply drive signals to the stepping motors 200, 222, a stepping motor 200 to rotatively drive the indicator hands 103, 104, a stepping motor 222 to rotatively drive the minute hand 101 and hour hand 102, an operation switch 108, a piezoelectric element 401 and a driver circuit 606 to drive the piezoelectric element.

The ROM 603 stores a program to operate the CPU 604, first, second and third storage area in the ROM 603 store first and second drive signal data to drive the first and second indicator hands 103, 104 and music data.

Here, the music data stored in the third storage area is data to output music from the piezoelectric element 401.

Also, the first drive signal data stored in first storage area is drive signal data to cause the first and second indicator hands 103, 104 to perform first reciprocal rotational movement in opposite directions to each other, e.g. to monotonously rotate in opposite directions to each other.

Also, the second drive signal data stored in second storage area is drive signal data to cause the first and second indicator hands 103, 104 to perform second reciprocal rotational movement in opposite directions to each other, e.g. to reciprocally move randomly to music in opposite directions to each other.

Figure 8:
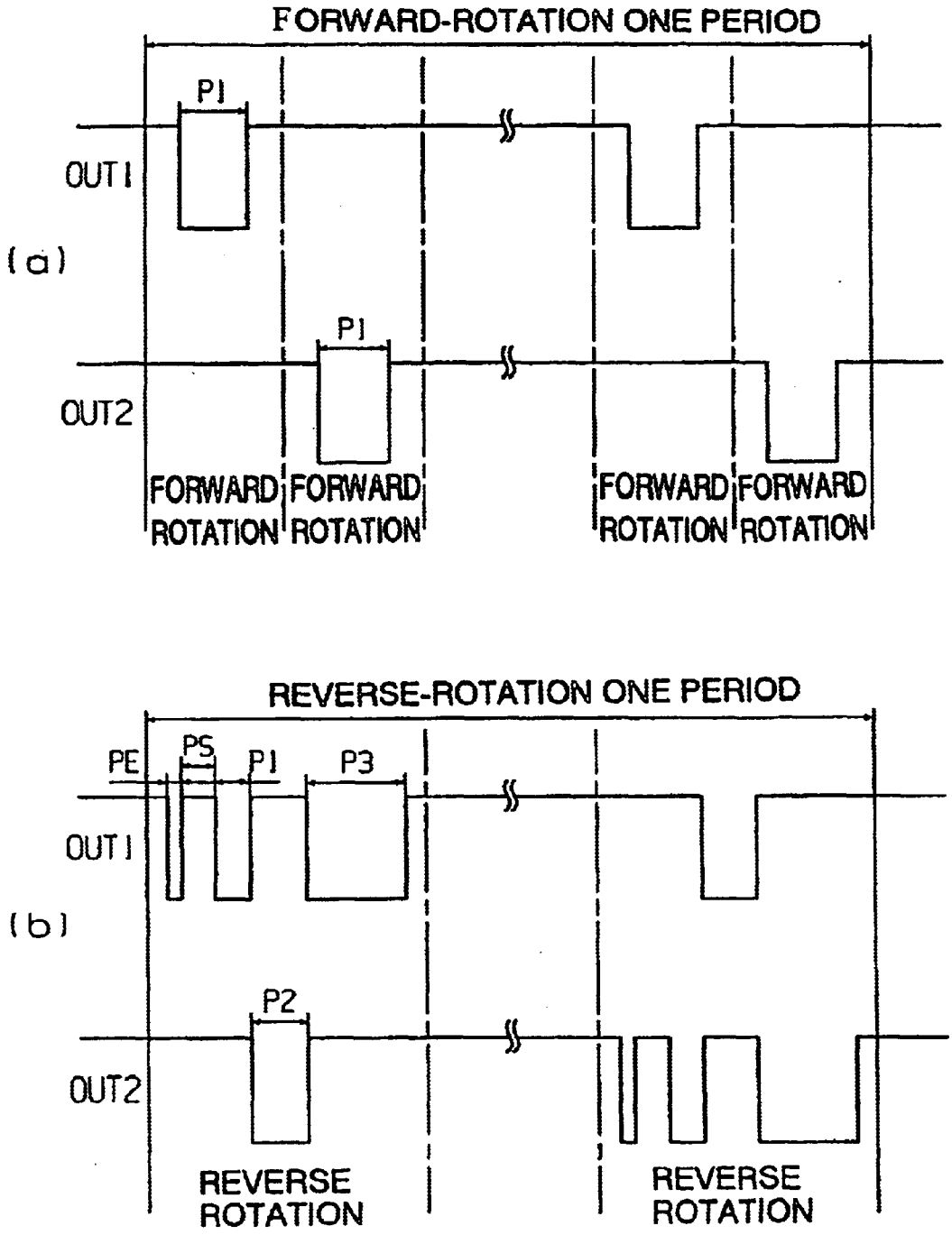
FIGS. 8A and 8B are timing charts for explaining the operation of the drive circuit shown in FIG. 7.

FIG. 8 shows an example of the first drive signal stored in the ROM 603. Where driving the stepping motor 200 forward and reverse, the CPU 604 reads a drive pulse out of the ROM 603 and drives the stepping motor 200 forward and reverse through the driver circuit 605 (e.g. see the Laid-open publication described before).

Hereunder, the operation of the present concrete example will be explained in detail using FIG. 1 to FIG. 8.

At first, explanation will made on a case that in FIG. 8 the operation switch 108 has not been operated.

The CPU 604 detects that the operation switch 108 has not been operated and outputs first drive signal data stored the first storage area in the ROM 603 to the motor 200 through the driver circuit 605. This causes the motor 200 to perform forward rotation and reverse rotation.

That is, where rotating the stepping motor 200 forward, as shown in FIG. 8(*a*) a pulse of a time width P1 is first applied to the terminal OUT 1 thereby causing forward rotation and, thereafter a pulse of a time width P1 is applied to the terminal OUT 2 thereby causing forward rotation. This operation is alternately repeated on a one-period basis (e.g. 10 times of forward rotational movements) thereby repeating forward rotations of the stepping motor 200.

Meanwhile, where rotating the stepping motor 200 reverse, as shown in FIG. 8(*b*) a demagnetization pulse of a time width PE is first supplied to the terminal OUT 1, and after lapse of a time PS a pulse of a time width P1 is supplied to once provide forward rotation. Thereafter, a reverse-rotation pulse of a time width P2 is supplied to the terminal OUT 2, and thereafter a reverse-rotation pulse of a time width P3 is supplied to the terminal OUT 1. This causes the stepping motor 200 to rotate reverse. The above operation is made by alternately exchanging signals applied to the terminal OUT 1 and terminal OUT 2 thereby making operation of one period (e.g. 10 times of reverse rotational movements).

Thereafter, the forward rotational movement and reverse rotational movement are alternately performed on a one-period basis to cause the stepping motor 200 to rotate forward and reverse over a predetermined amount of time. This operation is repeatedly performed.

This rotatively drives the rotor magnet 205 of the stepping motor 200 alternately in the forward direction and the reverse direction over a predetermined amount a time.

When the stepping motor 200 rotates by a predetermined number of times in the forward direction (in the arrowed direction in FIG. 3), the wheel 209, the wheel 210 and the hour wheel 212 each rotate in the arrowed direction. By this, the indicator hand 103 rotates over an angular range A in the arrowed direction (clockwise). Simultaneously, the wheel 211 meshing with the wheel 210 rotates in the arrowed direction to cause the hour wheel 213 to rotate in the arrowed direction, rotating the indicator hand 104 in the arrowed direction (counterclockwise) over the angular range A.

Next, when the stepping motor 200 rotates by a predetermined number of times in the reverse direction (in the arrowed direction in FIG. 3), the wheel 209, the wheel 210 and the hour wheel 212 rotate in the direction opposite to the arrow. By this, the indicator hand 103 rotates over the angular range A in the direction opposite to the arrow (counterclockwise). Simultaneously, the wheel 211 meshing with the wheel 210 rotates in the direction opposite to the arrow to cause the hour wheel 213 to rotate in the direction opposite to the arrow, rotating the indicator hand 104 in the direction opposite to the arrow (counterclockwise) over the angular range A.

Thereafter, the above operation is repeated. Due to this, the crescent-shaped figure 105 integral with the indicator hand 103 and the star-shaped figure 106 integral with the indicator hand 104 reciprocally move in opposite directions to each other over the same angular range A. Incidentally, the rotation range of the indicator hand 103, 104, i.e. the angular range A in FIG. 1, is determined by an amount (number) of forward and reverse rotations of the stepping motor 200. By variously setting the rotation amount of the stepping motor 200, the rotation range of the indicator hand 103, 104 can be variously set. Accordingly, the crescent-shaped figure 105 and the star-shaped figure 106 can be reciprocally rotated in various ranges.

Next, explanation will be made on a case that the operation switch 108 has been operated.

It is assumed that in the second storage area of the ROM 603 are stored, for example, five forward rotation pulse, four reverse rotation pulse, six forward rotation pulse, two reverse rotation pulse, . . . as the second drive signal and drive signal data for causing random movement of the indicator hands 103, 104. Incidentally, the drive signal data is previously selected such that the indicator hands 103, 104 move to the music data.

When the operation switch 108 is operated, the CPU 604 detect that and outputs the music data stored in the ROM 603 to the piezoelectric element 401 through the driver circuit 606. Due to this, music sounds from the piezoelectric element 401.

Simultaneously, the CPU 604 outputs the second drive signal data stored in the ROM 603 to the stepping motor 200 through the driver circuit 605. The stepping motor 200 reciprocally rotates in a random fashion according to the second drive signal data.

Due to this, the indicator hands 103, 104 randomly reciprocally rotate alternately in opposite directions thus moved to the music.

Figure 9:
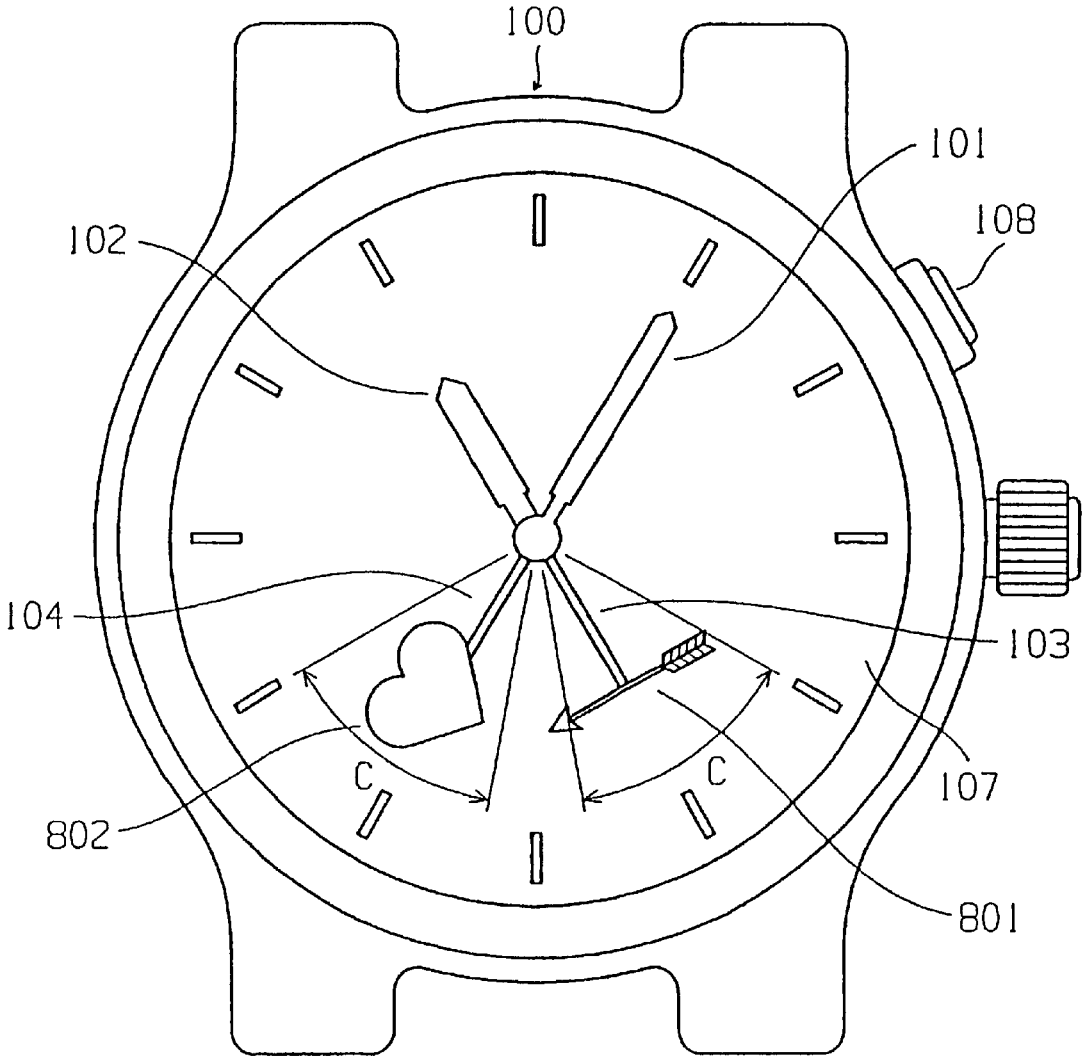
FIG. 9 is a front view showing an external appearance of another concrete example of an electronic timepiece with indicator hands according to the invention.

FIG. 9 is a front view showing an external appearance of another concrete example of an electronic timepiece with indicator hands according to the invention, wherein the same parts as in FIG. 1 are denoted by the same reference numerals.

In FIG. 9, an electronic wristwatch with indicator hands 100 has time hands comprising a minute hand 101 and an hour hand 102, and is provided with a first indicator hand 103 integrally formed with an arrow-shaped figure 801 and a second indicator hand 104 integrally formed with a heart-shaped figure 802. The indicator hands 103, 104 are arranged between the minute hand 101 and hour hand 102 and the dial 107. The indicator hands 103, 104 in pair are rotatively driven to reciprocally move at a same speed in directions opposite to each other within a same predetermined angular range C.

Figure 10:
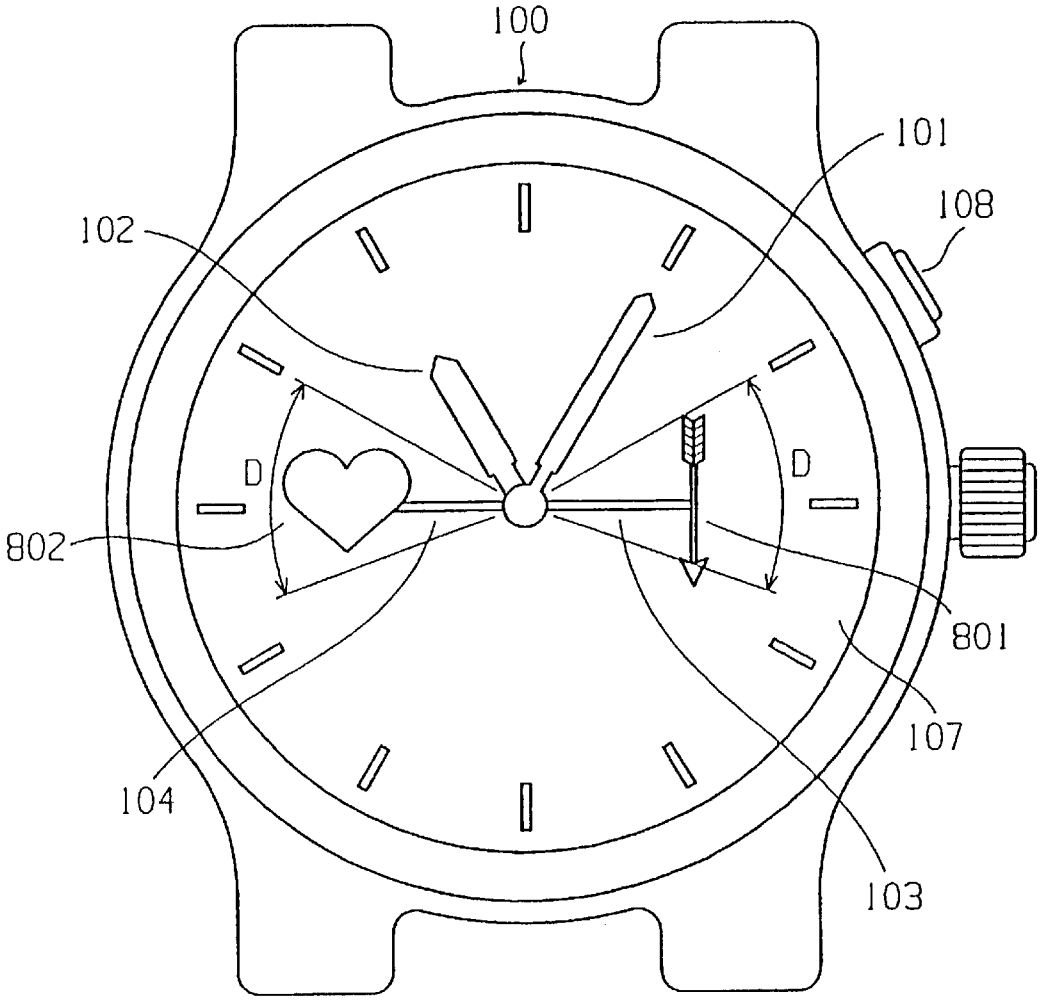
FIG. 10 is a front view showing an external appearance of another concrete example of an electronic timepiece with indicator hands according to the invention.

FIG. 10 is a front view showing an external appearance of another concrete example of an electronic timepiece with indicator hands according to the invention, wherein the same parts as in FIG. 1 and FIG. 9 are denoted by the same reference numerals.

In FIG. 10, an electronic wristwatch with indicator hands 100 has time hands comprising a minute hand 101 and an hour hand 102, and is provided with a first indicator hand 103 integrally formed with an arrow-shaped figure 801 and a second indicator hand 104 integrally formed with a heart-shaped figure 802. The indicator hands 103, 104 are arranged between the minute hand 101 and hour hand 102 and the dial 107. The indicator hands 103, 104 in pair are rotatively driven to reciprocally move at a same speed in directions opposite to each other within a same predetermined angular range D.

As shown in FIG. 1, FIG. 9 and FIG. 10, various forms of representation can be provided by changing the figures attached on the indicator hands 103, 104 to various figures such as characters, or the attaching angle of the indicator hands 103, 104 or the rotation angular range of the indicator hands 103, 104.

As described above, the electronic wristwatch with indicator hands 100 according the concrete examples of the invention is provided, particularly, with a first indicator hand 103 and second indicator hand 104 separately provided from time hands (minute hand 101, hour hands 102), and drive means (drive circuit 600 and the rotation means) to reciprocally rotate the first and second indicator hand 103, 104 in opposite directions to each other within a predetermined range.

Therefore, an electronic wristwatch 100 with indicator hands can be provided which is provided with indicator hands 103, 104 capable of a variety of representations.

Also, it is possible to represent movement to be made within a certain predetermined range, e.g., representation not to be made only by rotation in a single one direction, for example, forming character's both hands or both legs on the two indicator hands 103, 104.

Also, where figures of both hands are formed on the indicator hands 103, 104, it is possible to represent such motions as reciprocally moving pit-a-pat the both hands within a predetermined range of movement or widely waving the hand of the character by variously setting the attachment angle of the indicator hands 103, 104 or displaying to clap the hands.

Furthermore, because the indicator hands 103, 104 are being reciprocally moved at all times, where for example exhibited at a point of sale, differentiation is possible to achieve from other timepieces. Furthermore, by arranging the indicator hands 103, 104 between the hour hand and the dial 107, it is possible to provide a united feel with the design on the dial 107.

Also, the wheel 210 constitutes 2-stage structure by the gear 303 and the pinion 304 whose diameters are different, whose the number of teeth are the same and whose module of teeth are different. Therefore it is able to make the thickness of the hour wheels 212, 213 thin and to prevent motion deviation of the hour wheel 213.

That is to say, if the working between the wheel 210 and the hour wheel 212 is the same tooth profile as the working between the wheel 210 and the wheel 211, it thickens thickness of electric wrist timepieces, because the hour wheel 213 needs to remove the wheel 210 up and down in a sectional way. Also, if the wheel 210 constitutes 2 stages which a gear having tooth profile X which is in mesh the hour wheel 212 and a pinion having tooth profile Y which is in mesh the wheel 211, the diameter of the pinion 304 of the wheel 210 needs to be small to prevent meshing interference between the pinion 304 of the wheel 210 and the wheel 209. If it makes the diameter of the pinion 304 of the wheel 210 smaller, it makes motion deviation of the hour wheel 213 larger, because the diameter of the hour wheel 203 is small in the case of equalising a reduction ratio to drive the first indicator hand 103 and the second indicator hand 104. According to the embodiment of the present invention, these problems are solved.

Here, the wheels 209, 210 and the hour wheel 212 constitute a first wheel train to convey, to the first indicator hand 103, reverse rotation to the rotational direction of the motor 200 (i.e., rotation direction of the rotor magnet 205). The wheels 209, 210, 211 and the hour wheel 213 constitute a second wheel train to convey, to the second indicator hand 104, rotation in the same direction as the rotational direction of the motor 200.

Also, the drive means has an operation switch 108, sound output means (piezoelectric element 401), rotation means to reciprocally rotate the first and second indicator hands 103, 104 in opposite directions to each other, control means (CPU 604), and storage means (ROM 603) storing first drive signal data to control the rotation means such that the first and second indicator hands 103, 104 performs first reciprocal rotation movement in directions opposite to each other and second drive signal data to control the rotation means such that the first and second indicator hands 103, 104 performs second reciprocal rotation movement in directions opposite to each other. The control means structurally makes control such that, when the operation switch has not been operated, the rotation means causes the first and second indicator hands 103, 104 to perform first reciprocal rotation movement in directions opposite to each other by the first drive signal data and such that, when the operation switch 108 has been operated, the music data is outputted to the sound output means (piezoelectric element 401) and the rotation means causes the first and second indicator hands 103, 104 to perform second reciprocal rotation movement in directions opposite to each other by the second drive signal data.

Accordingly, the indicator hands 103, 104 can be driven to music thus enabling various representations.

Incidentally, in the above concrete examples, although the motor used the stepping motor 200 for timepieces structured by the coil 203, the stator 204 and the rotor magnet 205, a motor with another structure may be used.

Also, in the above concrete examples, although the indicator hands 103, 104 were made to rotate at a same speed, they may be rotated at different speeds from each other by changing the reduction ratio of the wheel train.

Furthermore, in the above concrete examples, the indicator hands 103, 104 were made same in rotation range, it may be made different.

Furthermore, in the above concrete examples, the time hands were structured by the minute hand 101 and the hour hand 102, a second hand may be added thereto.

INDUSTRIAL APPLICABILITY

As above, the electronic timepiece according to the present invention is applicable to various electronic timepieces ranging from electronic wrist watches to wall electronic timepieces and desk electronic timepieces.

What is claimed is:

1. An electronic timepiece comprising: a case; a time-indicating display provided in the case and comprising a dial having time-indicating indicia provided thereon and one or more time indicating hands mounted directly in front of the dial to cooperate with the time indicating indicia to indicate time; first and second indicator hands seperately provided from the time indicating hands and being mounted directly in front of the dial; and drive means for reciprocally driving the first and second indicator hands in opposite directions relative to each other within a predetermined angular range.

2. An electronic timepiece according to claim 1; wherein the drive means reciprocally drives the first and second indicator hands at the same speed.

3. An electronic timepiece according to claim 2; wherein the drive means includes a motor alternately rotatable in forward and reverse directions, and a wheel train for transmitting rotation of the motor to the first and second indicator hands.

4. An electronic timepiece according to claim 3; wherein the wheel train wheel comprises a first wheel train for transmitting rotation in a direction reverse to rotation of the motor to the first indicator hand, and a second wheel train for transmitting rotation in the same direction as rotation of the motor to the second indicator hand.

5. An electronic timepiece with indicator hands according to claim 4; wherein the time hand and the first and second indicator hands are rotatably arranged on a single shaft.

6. An electronic timepiece with indicator hands according to claim 3; wherein the wheel train comprises a first hour wheel for rotationally driving the first indicator hand, a second hour wheel for rotationally driving the second indicator hand, a third wheel interposed between the motor and the second hour wheel for reversing a direction of rotation of the motor to drive the second hour wheel in a reverse direction relative to the first hour wheel, and a two-stage wheel for transmitting rotation of the motor to the first hour wheel and transmitting rotation of the motor to the second hour wheel through the third wheel.

7. An electronic timepiece with indicator hands according to claim 6; wherein the two-stage wheel comprises a gear having a first diameter and a pinion having a second diameter smaller than the first diameter, the gear and the pinion having an equal number of teeth.

8. An electronic timepiece with an indicator hands according to claim 1; wherein the drive means comprises a manually operated switch, a sound output device, rotating means for reciprocally rotating the first and second indicator hands in directions opposite to each other, storing means for storing first drive signal data and second drive signal data, and control means for controlling the rotating means to cause the first and second indicator hands to perform first reciprocal rotational movement in directions opposite to each other in accordance with the first drive signal data when the operation switch has not been operated and outputting music data to the sound output device, and controlling the rotating means to cause the first and second indicator hands to perform second reciprocal rotational movement in directions opposite to each other in accordance with the second drive signal data when the operation switch has been manually operated.

9. An electronic timepiece according to claim 1; wherein the electronic timepiece is an electronic wristwatch.

10. An electronic timepiece according to claim 1; wherein the first and second indicator hands display fanciful images.

11. An electronic timepiece according to claim 10; wherein the images cooperate with each other to provide and animation when the first and second indicator hands are reciprocally driven in opposite directions relative to each other.

12. An electronic timepiece according to claim 10; wherein the images comprise astronomic figures.

13. An electronic timepiece according to claim 10; wherein the images comprise a heart and arrow.

14. An electronic timepiece according to claim 10; wherein the images comprise a person's hands.

15. An electronic timepiece according to claim 14; wherein the person's hands appear to clap when the first and second indicator hands are reciprocally driven in opposite directions relative to each other.

* * * * *